US006415727B1

(12) United States Patent
Burgess et al.

(10) Patent No.: US 6,415,727 B1
(45) Date of Patent: Jul. 9, 2002

(54) FLANGING MACHINE

(75) Inventors: F. Eddie Burgess, Easley; John Cordes, Greenville, both of SC (US)

(73) Assignee: Diversified Systems, Inc., Greenville, SC (US)

( * ) Notice: Subject to any disclaimer, the term of this patent is extended or adjusted under 35 U.S.C. 154(b) by 0 days.

(21) Appl. No.: 09/477,077

(22) Filed: Jan. 3, 2000

(Under 37 CFR 1.47)

Related U.S. Application Data

(60) Provisional application No. 60/123,435, filed on Mar. 9, 1998.

(51) Int. Cl.[7] ..... D05B 27/10; D05B 29/08; D05B 35/06

(52) U.S. Cl. ..... 112/304; 112/152; 112/235

(58) Field of Search ..... 112/235, 304, 112/318, 320, 322

(56) References Cited

U.S. PATENT DOCUMENTS

| | | | | |
|---|---|---|---|---|
| 1,661,023 A | | 2/1928 | Turner et al. | |
| 2,241,230 A | | 5/1941 | Wilmoth | |
| 3,208,418 A | | 9/1965 | Frydryk | |
| 3,540,391 A | | 11/1970 | Haye | |
| 3,828,704 A | | 8/1974 | Von Hagen et al. | |
| 4,719,864 A | * | 1/1988 | Barrett et al. | 112/304 X |
| 5,152,235 A | * | 10/1992 | Goto et al. | 112/304 X |
| 5,152,237 A | | 10/1992 | Block et al. | |
| 5,230,294 A | * | 7/1993 | Klein | 112/152 |
| 5,249,540 A | * | 10/1993 | Sielemann | 112/304 |
| 5,282,433 A | | 2/1994 | Freermann et al. | |
| 5,383,418 A | | 1/1995 | Block et al. | |
| 5,458,074 A | * | 10/1995 | Kojima et al. | 112/304 X |
| 5,617,804 A | | 4/1997 | Savio | |
| 5,664,510 A | | 9/1997 | Kitamura | |

FOREIGN PATENT DOCUMENTS

DE 0 006 487 A2 9/1980

* cited by examiner

*Primary Examiner*—Ismael Izaguirre
(74) *Attorney, Agent, or Firm*—Flint & Kim, P.A.

(57) ABSTRACT

The instant invention is directed to a flanging machine which utilizes a dual belt feeding assembly for grasping both surfaces of the material being fed to and through the sewing area. The arrangement provides for greater productivity, a more controlled and superior lateral feed, and the capability sewing material of increased thickness.

25 Claims, 5 Drawing Sheets

FLANGING MACHINE

This application claims priority of U.S. Provisional Ser. No. 60/123,475, filed Mar. 9, 1999.

BACKGROUND OF THE INVENTION

In industrial sewing, it has long been known that precision of the feeding and control of the fabric through the sewing area is of primary concern, particularly in the area of upholstery fabrics and mattress covers. Due to the thickness of these fabrics, the amount of lift of the presser foot above the throat plate is also a concern.

Various efforts have been made to improve the control and feed of the fabric such as providing a feed belt to work in combination with the feed dog or feed belt in lieu of the feed dog as is illustrated in U.S. Pat. Nos. 1,661,023; 2,241,230; 5,383,418 to Turner et al; Wilmoth; and Block et al. To date, no arrangement has been presented which satisfactorily meets the necessary fabric feed and control requirements.

The instant invention has for its primary object a fabric feed system for a sewing machine which positively grips and controls the fabric as it is moved through the sewing area.

Another object of the invention is a feed system for a sewing machine which utilizes an upper feed belt in cooperation with a lower feed belt to grip and move the fabric through the sewing area.

Another object of the invention is a presser foot which guides the upper belt through the sewing area and positions it in engagement with the fabric during sewing.

Another object of the invention is a presser foot which presents a multi-level pressure surface.

Another object of the invention is a mounting assembly for the lower feed belt which is positionable in an operative position and a cleaning position.

Another object of the invention is a lower belt feed system which includes a plurality of feed belts.

Another object of the invention is a drive system which drives the upper and lower feed belts in synchronism with each other and with the movement of the sewing needle.

SUMMARY OF THE INVENTION

The instant invention is directed to a sewing machine assembly which comprises a machine frame, a machine drive, a sewing area which includes a presser foot and at least one reciprocating sewing needle, and a cloth plate having a work surface over which a fabric work piece travels to and through the sewing area. A continuous lower feed belt is positioned to rotate over the feed plate, beneath the presser foot and through the sewing area. A lower belt drive, which is driven by a feed drive, is connected with the machine drive, is adapted to drive the lower belt in rotary step movement in synchronism with the reciprocating movement of the sewing needle. A lower belt housing, which carries the feed plat, the lower belt drive and the lower belt, is positionable between an operative position in which the lower belt and the cloth plate are positioned beneath the presser foot in the sewing area and an inspection position in which the lower belt and the cloth plate are separated from the presser foot and the sewing are. The feed drive is operative to drive the lower belt drive with the belt housing in the sewing position or the inspection position.

The assembly also includes a continuous upper feed belt positioned to rotate over the feed plate, over the lower belt and beneath the presser foot. The presser foot is mounted with a presser bar which is adapted to move the presser foot between a raised position in which the upper feed belt and presser foot are separated from the lower feed belt and an operating position in which the presser foot positions the upper feed belt in engagement with the lower feed belt in the sewing are. The upper belt is also driven by the feed drive and an upper belt drive. The upper belt assembly includes a drive gear, idler pulleys, a tensioning device and the presser foot. The tensioning device, which includes a pneumatic cylinder and an idler roller, acts to maintain the upper belt under proper tension with the presser foot in the raised position and in the lowered position.

If desired there may be two lower belts arranged in spaced side by side positions over the cloth plate. Also, if desired, a second upper belt may be provided to cooperate with the second lower belt.

The presser foot includes a groove defined by inner and outer presser ramps, each ramp has a lower fabric contact surface. The fabric contact surfaces of each ramp are disposed along vertically spaced horizontal planes. A material feeding system for cooperative use with at least one reciprocating sewing needle wherein sewing is accomplished. The feeding system includes a sewing area including a presser foot, a cloth plate having a work surface over which a fabric is advance, at least one continuous lower feed belt formed with a gripping surface comprising a plurality of spaced teeth arranged to move over the work surface and through said sewing area, and at least one continuous upper feed belt formed with a gripping surface comprising a plurality of spaced teeth arranged to move over at least a lower belt, through the sewing are and beneath the presser foot. A presser bar mounts the presser foot and acts to position the presser foot and the upper belt in a raised position in which material may be positioned in the sewing area and a lowered position in which the presser foot and the upper belt are moved toward the lower belt and into engagement with the material being sewn.

Upper and lower drives move the upper and lower belts in step rotational motion about belt mountings in synchronism with the reciprocating motion of the sewing needle.

The arrangement allows the fabric to be inserted into the sewing area with the presser foot in the raised position where it is first gripped and then drawn beneath the presser foot through and out of said sewing are by the upper and lower feed belts with said presser foot in the lowered position. The presser bar is driven by a piston between upper and lower positions to move the presser foot between the raised and lowered positions. The piston acts to raise and lower the presser foot a distance of about one inch.

The drive of the sewing needles and of the loopers is substantially conventional and is substantially disclosed in various prior disclosures such as U.S. Pat. Nos. 2,241,230 and 5,664,510.

DESCRIPTION OF THE DRAWINGS

The instant invention is directed to a flanging machine which utilizes a dual belt feeding assembly for grasping both surfaces of the material being fed to and through the sewing area. The arrangement provides for greater productivity, a more controlled and superior lateral feed, and the capability increased thickness of material being sewn.

Illustrations include the following photographs and copies thereof which are identified as.

DESCRIPTION OF A PREFERRED EMBODIMENT

The structure of the sewing assembly, to include the drive for the upper and lower feed assemblies will now be described in detail.

Figure 1:
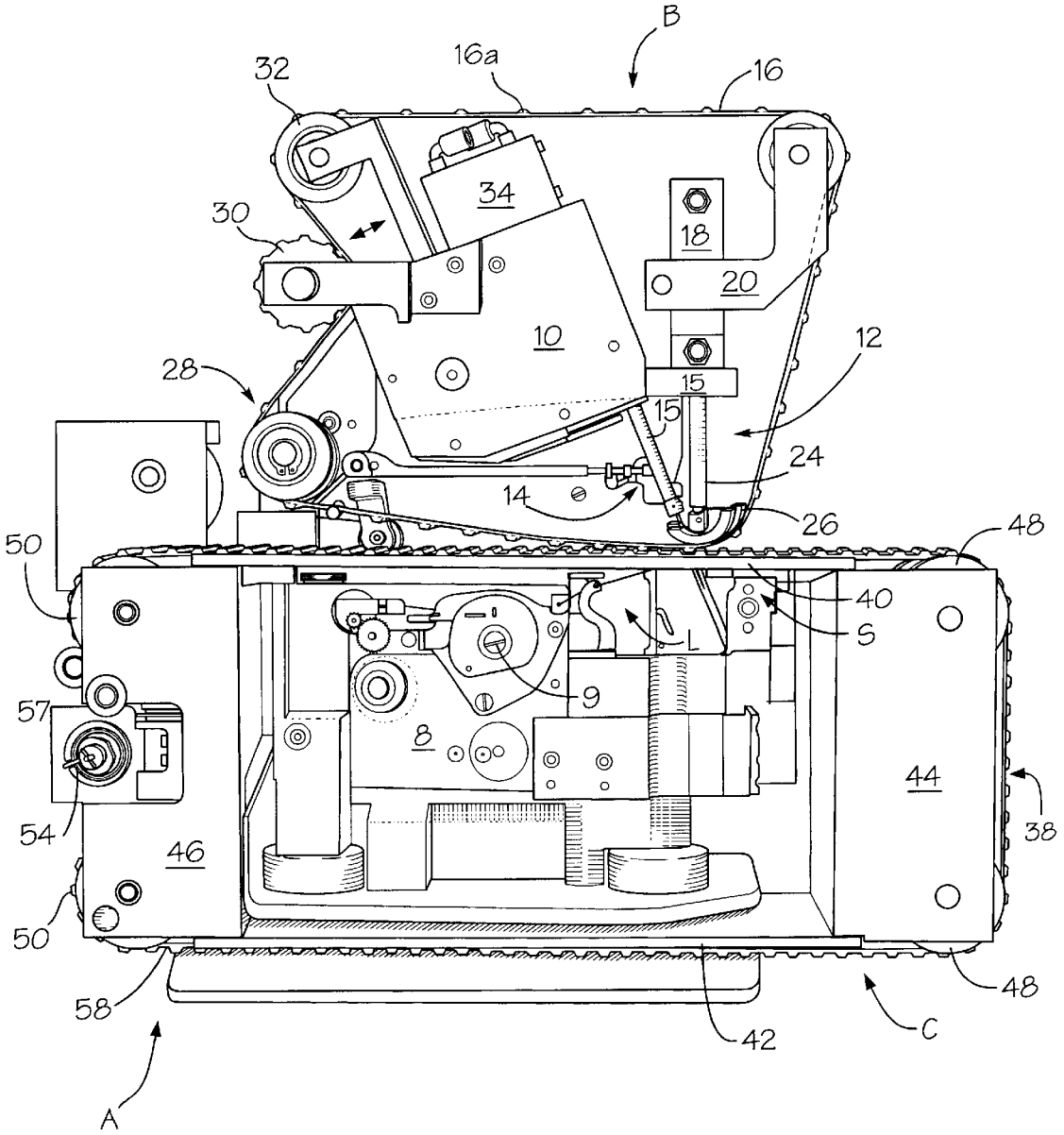
FIG. 1 is a side view.
Figure 2:
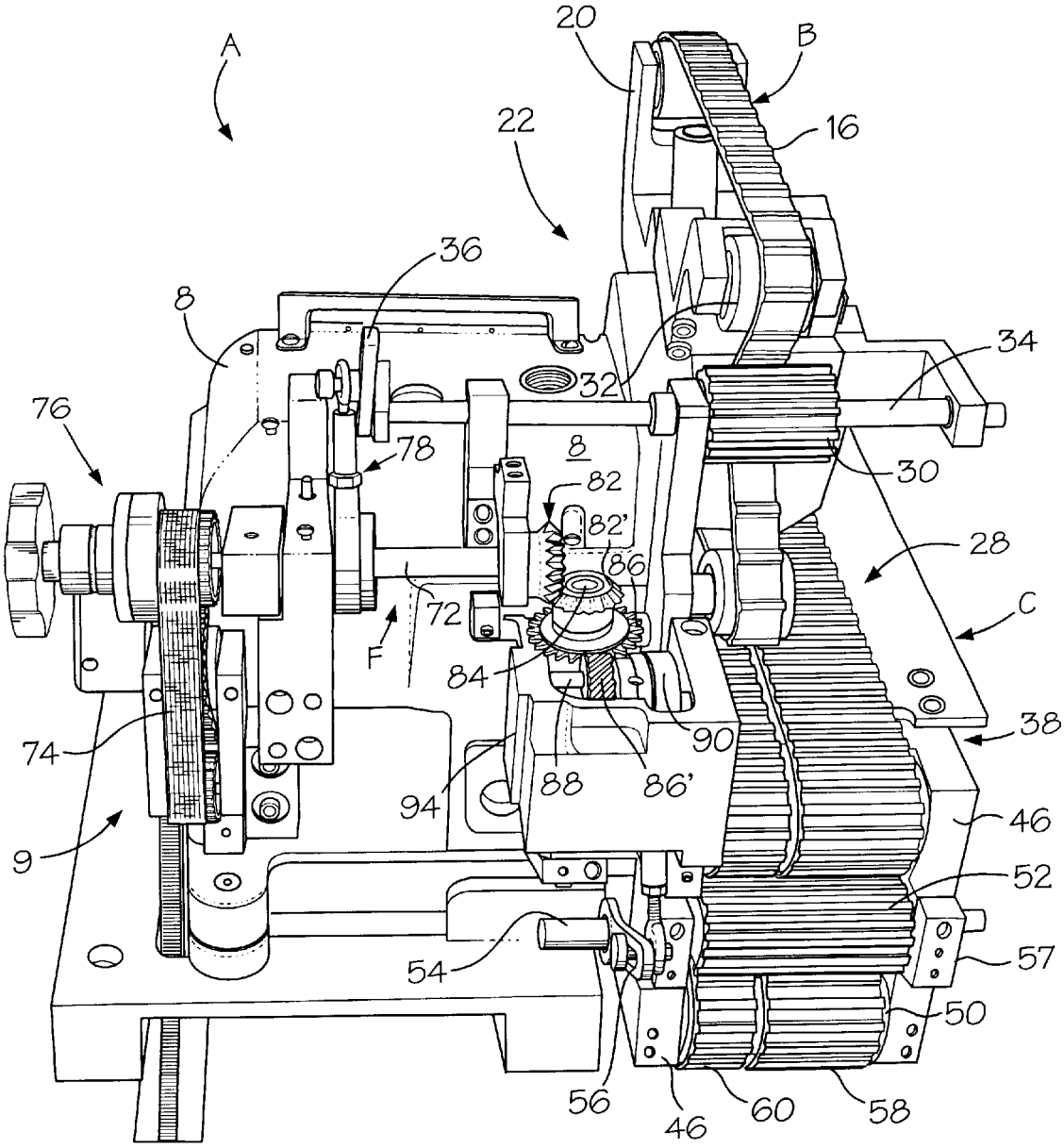
FIG. 2 is a general rear perspective view of the sewing machine, the feed assemblies, and the feed drive assemblies.

Turning now to FIGS. 1 and 2, the general structure of the sewing or flanging machine A can be seen. Main housing 8 carries machine drive 9 which powers the sewing needle assembly and the looper assembly L in the usual manner.

An upper feed assembly B is carried at one side of housing 8 and includes upper feed housing 10, presser foot assembly 12, sewing needle drive assembly 14, and upper feed belt 16 and the upper feed belt mounting and drive assembly.

Mounted on the front side of housing 10 is shelf 15 which carries vertical arm 18 and idler assembly 20. Vertical arm 18 supports piston 22 (FIG. 2) which in turn controls the position of presser bar 24 which carries at its lower end presser foot 26. Piston 22 is actuated between raised and lowered positions in the usual manner. The presser foot assembly will be described in more detail later.

A rear idler assembly 28 is arranged below drive member 30 which in turn is below tensioning roll 32. Piston 34 which is mounted atop housing 10 mounts tensioning roll 32 and acts to maintain proper tension on belt 16 with the presser foot in its raised and lowered positions by moving roll 32 in the directions indicated by the arrow.

Upper feed belt 16, which preferably is formed with spaced teeth 16*a* on its outer surface and has a smooth inner surface, is passed over the pulley of idler assembly 20 to tensioning roll 32 and then beneath drive member 30. Feed belt 16 then passes over idler assembly 28 to and beneath presser foot 26 and back to idler assembly 20.

The upper feed belt drive comprises drive member 30, which preferably comprises a gear carried by shaft 34. Shaft 34 carries at its opposite end crank 36. Shaft 34 is rotably carried by housing 8 as shown in FIG. 2.

Lower feed assembly C includes lower belt housing 38 which comprises cloth plate 40 and lower guide plate 42 each connected at opposed ends with vertical end members 44, 46. Idler pulleys 48 are carried by front end members 44 in vertically spaced positions. Idler pulleys 50 are similarly carried by rear vertical member 46. Drive member 52, preferably a gear, is mounted on shaft 54 carried by end member 46 and positioned between idler pulleys 50. Shaft 52 carries at one end crank 56. Bearings 58, which are horizontally shiftable relative to vertical members 46 adjustable mount shaft 54 relative to end member 44.

Lower feed belts 58, 60 pass over plates 40, 42, over idler pulleys 48, 50, and beneath drive 52. Proper tension is obtained by adjusting bearings 58.

Figure 5:
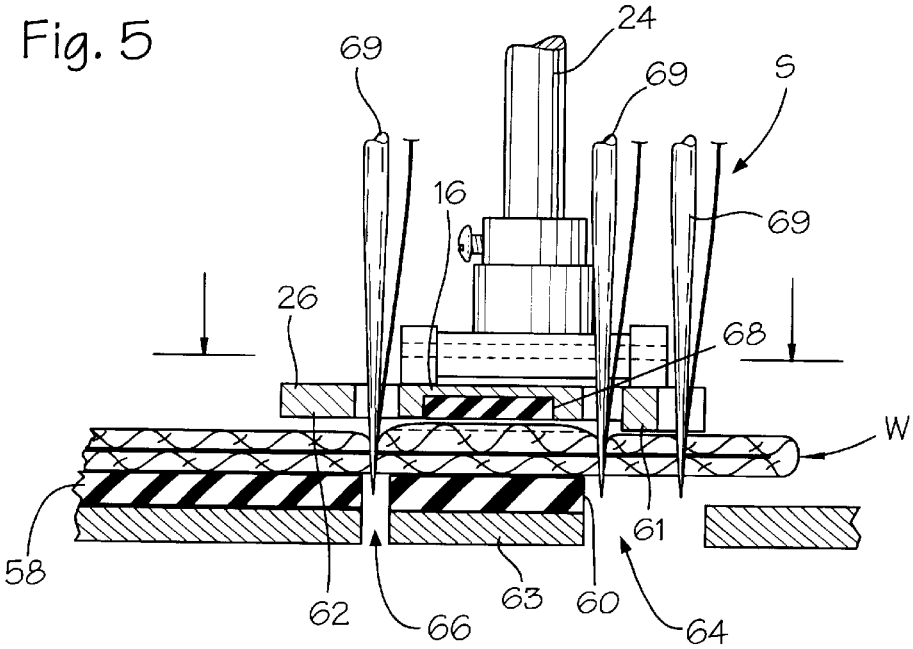
FIG. 5 is an end view of the needle relative to feed assemblies.
Figure 6A:
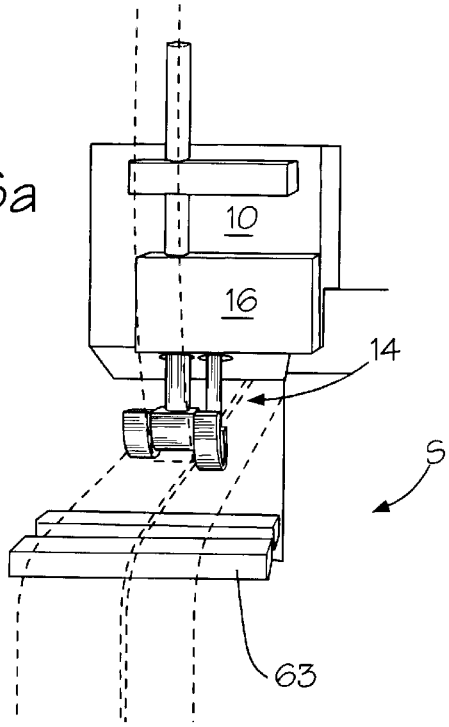
FIG. 6*a* is a end view of the presser foot in raised position.
Figure 6B:
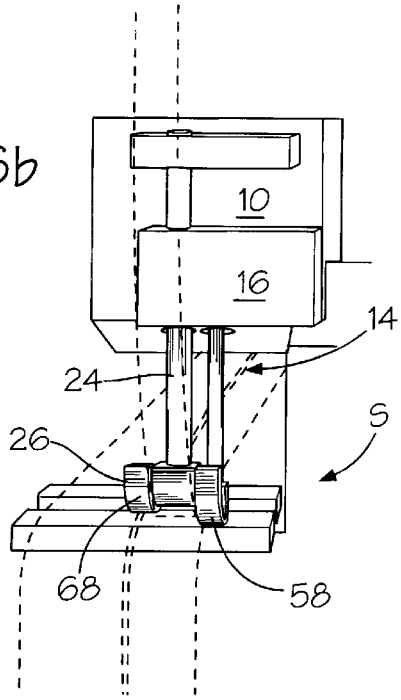
FIG. 6*b* is an end view of the presser foot in the upper and lower feed belts in operative lowered position.

Inner feed belt 60 is positioned to be vertically beneath upper feed belt 16 while outer feed belt 58 is spaced by between 1/16" and ½" outwardly thereof as shown in FIG. 5.

Turning now to FIGS. 1, 5, 6*a*, and 6*b*, presser foot 26 is shown as associated with the sewing needle and needle drive 14, with upper feed belt 16 and lower feed belts 58, 60 and with the sewing area S. The lower surface of presser foot is formed with a pair of presser ramps 61, 62 each having an upwardly directed forward end and horizontal lower surfaces. The lower surfaces of each ramp are designed to engage the upper surface of cloth W and press it downwardly onto the cloth plate 40 and against throat plate 63 in sewing are S. Ramps 61, 62 also press cloth W against the upper surface of lower feed belts 58 and 60. Inner ramps 61 which is positioned over the larger opening 64 of the two openings 64, 66 in throat plates 63, has its horizontal surface located vertically below the horizontal surface of outer ramp 62. This provides for greater pressure and a more stable grip of the cloth W as it passes through the sewing area S. Cloth W is not only pressed against the upper surface of lower belt 60, it is firmly against the inner edge of inner feed belt 60 as it passes over the throat plate and through the sewing area S.

The space between ramps 61, 62 forms groove 68 which receives and guides upper belt 16 through sewing area S and maintains it properly positioned vertically of lower belt 60.

The arrangement shown utilizes three sewing needles 69 all carried by a single needle shaft 15. As shown, the inner two of needles 69 pass through the larger of the clearance holes 64 while the outer needle 69 passes through outer clearance hole 66. The needles cooperate with the looper mechanism L in usual manner. It is noted that innermost needle 69 may cooperate with a single looper which allows increased looper height through adjustment of the looper. The general structure of the looper needle assembly is disclosed in U.S. Pat. No. 5,383,418.

Figure 3:
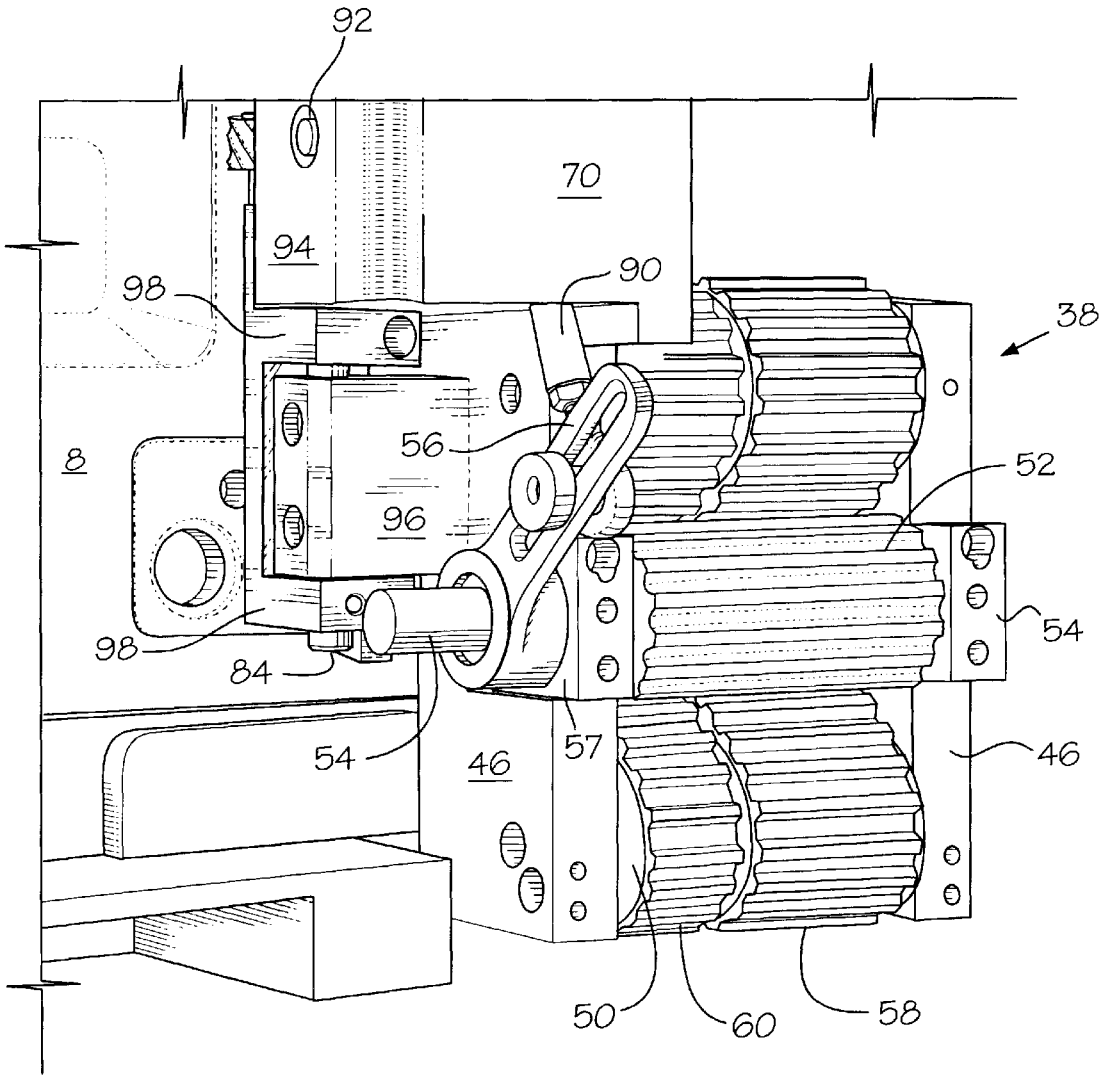
FIG. 3 is a detailed perspective view of the drive for the lower feed assembly.
Figure 4:
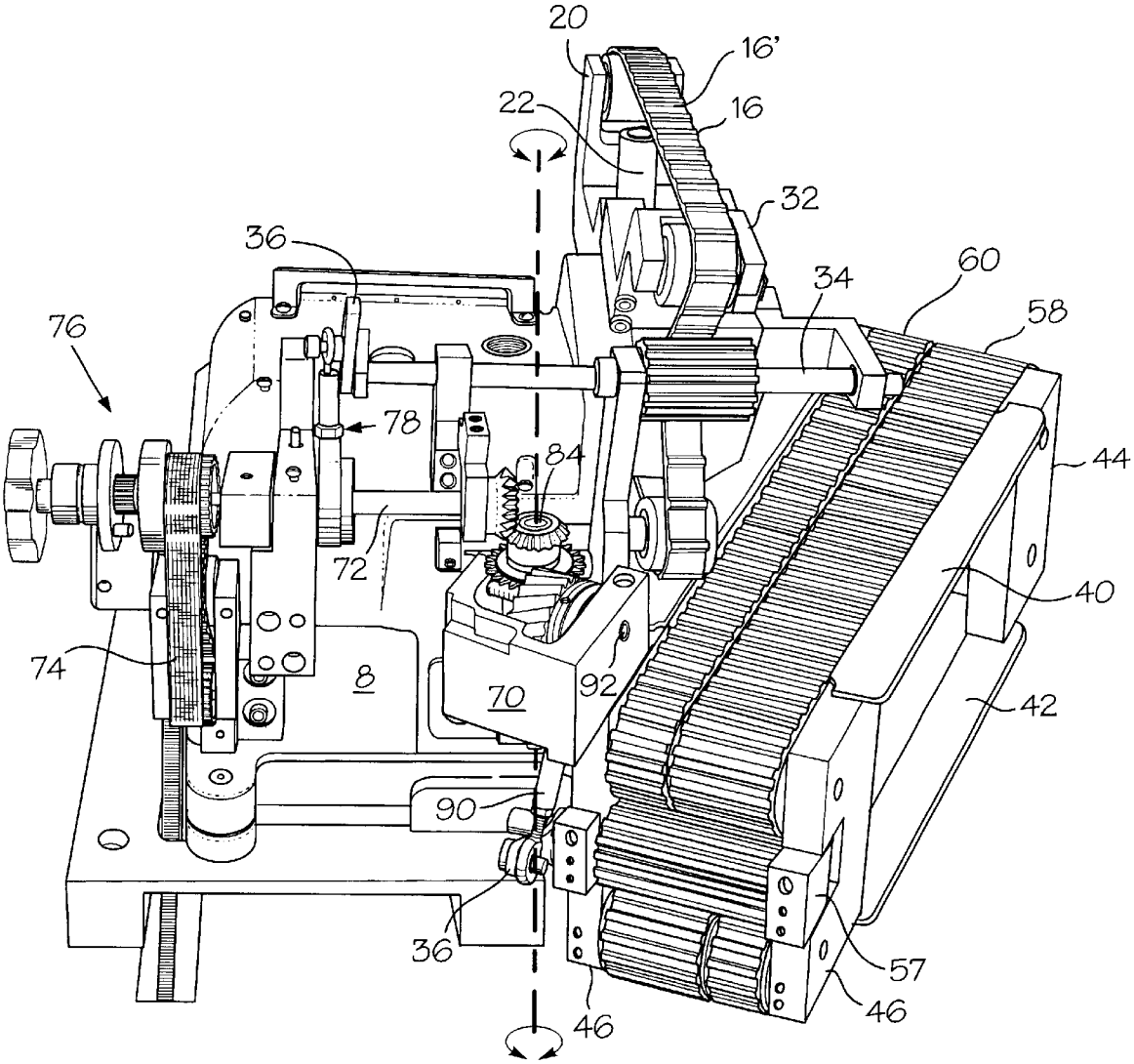
FIG. 4 is a perspective view of the drive for the feed assemblies with the lower belt housing pivoted away from the machine frame.

Turning now to FIGS. 3–5, the feed drive F will now be described. Main shaft 72 is rotably driven by machine drive 9 through drive chain 74 and clutch 76 which is carried on the main shaft. Eccentric linkage 78 is connected with crank 36 which in turn drives shaft 34 as earlier described. Eccentric linkage 78, which consists of an eccentric mounted on shaft 72 and a lever mounted on and driven by the eccentric, converts the continuous rotary drive of main shaft 72 to step rotary motion for shaft 34.

Cam 76 may be disconnected as shown in FIG. 4 which allows the main drive to be rotated without effecting the feed belts or the feed belts may be rotated without effecting the main drive.

Main shaft 72 also carries sprocket gear 82 which meshes with sprocket gear 82' mounted on vertical shaft 84 at one end. Vertical shaft 84 is supported by bearings (not shown) carried on main housing 8. Also mounted on vertical shaft 84 is a second gear 86 meshed with gear 86' carried on shaft 88. Shaft 88 carries eccentric linkage 90 which connects with crank 56 carried on one end of shaft 54. Here as above, eccentric linkage 90 converts the continuous rotary of main shaft 72 into step rotary motion for shaft 54.

Main shaft 72 through the described gearing drives both the upper feed assembly B and the lower feed assembly C in controlled sequence.

Lower feed housing 38 includes a gear box 70 mounted at its upper rear end. Gear box 70 is generally U-shaped and carry a pair of opposed bearings 92 (one shown) which mounts shaft 88. Arm 94 of housing 70 also carries a bearing (not shown) which is arranged above bearing 96 carried by end member 46. These bearings are vertically aligned and mount vertical shaft 84. A second pair of vertically spaced and aligned bearings 98 are secured with housing 8. As best shown in FIG. 3 bearings 98 also mount shaft 84. These bearings pivotally mount housing 38 with frame 8 allowing it to be swung outwardly away from sewing area S to facilitate access of looper and needle assembly L for threading, cleaning and other needs in that area of the sewing machine. It is noted that the drive from machine drive 9 through lower feed belts 58, 60 remains connected regardless of the position of housing 38.

It is noted that upper feed assembly could comprise a pair of feed belts 16 with the outer belt positioned over the outer lower feed belt 58. Such an arrangement would simply require duplicating the idler, tensioning assemblies, adding an additional drive element to shaft 34 and an additional guide groove to presser foot 26.

It is also noted that needle shaft 15 along with needle drive 14 are arranged behind but closely adjacent presser foot assembly 12. This allows for sewing to take place at the point of maximum control of cloth W in the sewing area S, i.e., that area beneath presser foot 26. Also, by having shaft 15 and presser bar 24 closely assembled, a clearance of at least one inch may be obtained when the presser foot and needle are raised.

What is claimed is:

1. A sewing machine assembly comprising:

a machine frame;

a machine drive a sewing area including a presser foot and at least one reciprocating sewing needle;

a cloth plate having a work surface over which a fabric work piece travels to and through said sewing area;

a continuous lower feed belt positioned to rotate over said feed plate, beneath said presser foot and through said sewing area;

a lower belt drive driven by a feed drive connected with said machine drive, said lower belt drive being adapted to drive said lower belt in rotary step and in synchronism with said sewing needle;

a lower belt housing carrying said feed plate, said lower belt drive and said lower belt; and, a mounting member mounting said lower belt housing in an operative position in which said lower belt and said cloth plate are positioned beneath said presser foot in said sewing area and in an inspection position in which said lower belt and said cloth plate are separated from said presser foot and said sewing area.

2. The sewing machine of claim 1 wherein said feed drive drives said lower belt drive with said belt housing in said sewing position and said inspection position.

3. The sewing machine of claim 1 including a second lower belt arranged in parallel with said lower belt, said lower belt drive driving said second lower belt in synchronism with said lower belt.

4. The sewing machine of claim 1 wherein said feed drive includes linkage which converts continuous rotating motion of said machine drive into step rotary motion for said lower belt drive.

5. The assembly of claim 1 including a continuous upper feed belt positioned to rotate over said feed plate, over said lower belt and beneath said presser foot.

6. The assembly of claim 5 including a presser bar mounting said presser foot, said presser bar being adapted to move between a raised position in which said upper feed belt and said presser foot are separated from said lower feed belt and an operating position in which said presser foot positions said upper feed belt in engagement with said lower feed belt in said sewing area.

7. The assembly of claim 5 including an upper belt drive driven by said feed drive.

8. The assembly of claim 7 wherein said upper belt drive includes a drive gear, idler pulleys, a tensioning device and a guide track, said tensioning device acting to maintain said upper belt under proper tension with said presser foot in said raised position and said lowered position.

9. The assembly of claim 8 wherein a pneumatic cylinder urges said tensioning device against said upper belt.

10. The assembly of claim 1 including an upper feed belt and upper feed belt drive driven by said feed drive, wherein said feed drive converts continuous rotary motion of said machine drive into step rotary motion for said upper and lower feed belt drive.

11. The assembly of claim 10 wherein said feed drive includes a rachet driven by an eccentric for converting said continuous rotary motion to stop rotary motion.

12. The assembly of claim 1 wherein said presser foot includes a groove defined by an inner and an outer presser ramp, each said ramp having a lower fabric contact surface.

13. The assembly of claim 12 wherein said fabric contact surfaces of said inner and outer presser ramps are disposed along different vertical planes.

14. The sewing machine assembly of claim 1 wherein said mounting member includes a vertically disposed shaft pivotally mounting said lower belt housing with said machine frame.

15. The sewing machine assembly of claim 14 wherein said feed drive includes said vertically disposed shaft and first and second horizontally disposed shafts, said vertical shaft and said horizontal shafts being interconnected and rotably driven by said machine drive.

16. The sewing machine assembly of claim 15 wherein said second horizontal shaft is connected with an eccentric drive, said eccentric drive driving said lower belt drive in step rotary motion.

17. The sewing machine assembly of claim 16 including a gear housing connected with one end of said lower belt housing, said gear housing mounting said second horizontal shaft.

18. A material feeding system for cooperative use with at least one reciprocating sewing needle wherein sewing is accomplished, said feeding system including:

a sewing area including a presser foot;

a cloth plate having a work surface over which a fabric is advanced;

at least one continuous lower feed belt formed with a gripping surface comprising a plurality of spaced teeth, said lower belt being arranged to move over said work surface and through said sewing area;

at least one continuous upper feed belt formed with a gripping surface comprising a plurality of spaced teeth, said upper belt being arranged to move over said at least one lower belt through said sewing area and beneath said presser foot;

a presser bar mounting said presser foot, said presser bar being adapted to position said presser foot and said at least one upper belt in a raised position in which said material may be positioned in said sewing area and a lowered position in which said presser foot urges said at least one upper belt toward said lower belt engaging said material between said belts;

an upper feed belt carriage assembly adapted to support and move said upper feed belt through said sewing area, said upper feed belt carriage assembly including a pneumatic control, a drive roll, idler rolls, a tension roll, and said presser foot, said pneumatic control urging said tensioning roll against said upper feed belt and maintaining said upper feed belt under proper tension with said presser foot in said raised and lowered position;

an upper and lower drive driving said upper and lower belts in step rotational motion which is synchronized with the reciprocating motion of said at least one sewing needle; whereby, said fabric may be inserted into said sewing area beneath said presser foot in said raised position and gripped and drawn beneath said presser foot, through and out of said sewing area by said at least one upper and lower feed belts with said presser foot in said lowered position.

19. The system of claim 18 wherein said presser bar is driven by a piston between upper and lower positions to move said presser foot between said raised and lowered positions.

20. The system of claim 19 wherein said raised and lowered position are separated by about one inch.

21. A presser foot for use in a sewing machine assembly including an upper feed belt, a lower feed belt, a plurality sewing needle, a throat plate and a sewing area;

said throat plate having inner and outer openings arranged transversely of said upper feed belt for receiving said plurality of sewing needles during their downward stroke through said sewing are, said inner opening having a width at least three times that of said outer opening;

said presser foot having inner and outer presser ramps separated by a groove extending longitudinally of said presser foot, said groove being adapted to guide said upper feed belt through said sewing area; and, said inner presser ramp being disposed along a plane vertically below said outer presser ramp.

22. The presser foot of claim 21 including a presser bar connected with said presser foot, said presser bar being adapted to move said presser foot into a lower sewing position and a raised retracted position, said retracted position positioning said inner and outer presser ramps about one inch above said throat plate.

23. The presser foot of claim 21 wherein said sewing needles comprise an outer, an intermediate, and an inner sewing needle arranged along a single plane transversely of said sewing area, said inner and intermediate of said sewing needles being adapted to pass through said inner opening of said throat plate and said outer sewing needle being adapted to pass through said outer opening of said throat plate.

24. The presser foot of claim 21 wherein said throat plate includes a guide separating said inner and outer throat plates, said guide supporting said lower feed belt through said sewing are.

25. The presser foot of claim 24 wherein said guide is disposed beneath said groove and said upper feed belt.

* * * * *